US006525658B2

(12) United States Patent
Streetman et al.

(10) Patent No.: US 6,525,658 B2
(45) Date of Patent: Feb. 25, 2003

(54) METHOD AND DEVICE FOR EVENT DETECTION UTILIZING DATA FROM A MULTIPLICITY OF SENSOR SOURCES

(75) Inventors: Steven S. Streetman, Upper Marlboro, MD (US); Matthew W. McGarvey, Springfield, VA (US)

(73) Assignee: Ensco, Inc., Springfield, VA (US)

( * ) Notice: Subject to any disclaimer, the term of this patent is extended or adjusted under 35 U.S.C. 154(b) by 2 days.

(21) Appl. No.: 09/877,023

(22) Filed: Jun. 11, 2001

(65) Prior Publication Data

US 2002/0196140 A1 Dec. 26, 2002

(51) Int. Cl.[7] ..... G08B 19/00

(52) U.S. Cl. ..... 340/522; 340/506; 340/517; 340/521; 340/523; 340/526; 340/527

(58) Field of Search ..... 340/522, 506, 340/517, 521, 523, 526, 527

(56) References Cited

U.S. PATENT DOCUMENTS 5,181,010 A * 1/1993 Chick ..... 340/426
6,232,873 B1 * 5/2001 Dilz et al. ..... 340/426

* cited by examiner

*Primary Examiner*—Daryl Pope
(74) *Attorney, Agent, or Firm*—Nixon Peabody LLP; Jeffrey L. Costellia

(57) ABSTRACT

A method and apparatus for event detection utilizing data from a multiplicity of sensors is provided. In a first step, actual detections from a plurality of sensors identified with predetermined sensor sequences, each indicative of an event, are compared with the predetermined sensor sequence to determine whether the times between the actual detections match the times allocated between detections for any predetermined sensor sequence. If a match occurs, the event indicated by the matching predetermined sensor sequence is provided. If no match occurs, a second step is initiated wherein the actual detections are compared to a predetermined script file which defines criteria for a plurality of events. If this criteria is matched, the event for which the criteria is provided is indicated.

13 Claims, 4 Drawing Sheets

METHOD AND DEVICE FOR EVENT DETECTION UTILIZING DATA FROM A MULTIPLICITY OF SENSOR SOURCES

BACKGROUND OF THE INVENTION

It is often advantageous to deploy sensors to provide information to facility security personnel or to gain intelligence about a remote site. Sensors are relatively cheap (compared to personnel) and can provide a variety of reliable information. There are drawbacks to current sensor deployments, however. The sensors used are simple and often unable to distinguish between significant events and false detections triggered by insignificant nuisance events. If more sophisticated sensors are deployed, they require expert analysis to interpret their results. Further, sensors are single domain: a microphone hears sounds, a camera sees visible light, and a motion detector responds to movement. Sensors are also prone to false alarms.

One way to respond to these failings is to deploy multiple sensor types and use the combined sensor evidence to perform a situation assessment. Current state of the art tries to accomplish this either by co-locating individual sensor systems resulting in numerous monitors for an operator to view and respond to, or by displaying multiple individual sensor systems on a common display. These strategies are inadequate because they rely on an (often poorly trained and unknowledgeable) operator to determine what happened based on the sensor outputs which may be many and conflicting. In most security situations, the only effective method is to install numerous cameras and require the operator to visually confirm all sensor alarms. Sensors are used as cues for the cameras. This strategy is adequate for conventional threats in a facility of sufficient priority to justify the expense of the cameras, but is inappropriate for less critical facilities and not feasible for monitoring remote sites.

SUMMARY OF THE INVENTION

It is a primary object of the present invention to provide a method and device for detecting the occurrence of an event by associating detection outputs from a plurality of different detection devices into a single event and characterizing the event based upon all detection information.

Another object of the present invention is to provide a method for event detection utilizing all data from many different types of sensors to perform an event analysis.

A still further object of the present invention is to provide a method for identifying and characterizing events based upon a multiplicity of sensor inputs which uses event identifiers and location information to determine association of events into objects. Associated sensor detections are combined into a single event identified and characterized by all sensor outputs thereby reducing false alarms.

These and other objects of the present invention are achieved by providing a method and device for obtaining information from a plurality of different types of sensors including photo or video data as well as raw sensor measurements. These sensor detections, including the photo or video data, are associated to create events, each of which is characterized and annunciated to an operator. Events are associated into objects/processes using all available information to allow longer term analysis of operations and determine trends. The present invention does not rely on structure for event identifiers, can optionally use location information, and can use operational time patterns for object fusion. Thus, the invention uses all available information for fusion from events into objects and can use each type of information in an optimal manner for each situation.

The method and device of the present invention provides:

1. Capability to automatically associate sensor detections into events (create an event view).
2. Capability to use all types of sensor information, including raw measurements, extracted features, and all types of existing sensor provided information.
3. Capability to identify the events based on all the sensor evidence (which may reduce false alarms and nuisance alarms).
4. Capability to characterize the event and annunciate to an operator in a variety of ways (calculate event information based on the type of event and provide automated response as desired.
5. Capability to associate events into objects/processes using all available information in the most appropriate manner.

DESCRIPTION OF THE PREFERRED EMBODIMENTS

The apparatus and method of the present invention identifies and characterizes events based upon all of a plurality of sensor inputs rather than upon the input from a single sensor. An operator will then see a single event rather than numerous and possibly conflicting individual sensor detections. The device of the present invention is able to accept and use effectively many different types of sensor inputs including all of those commonly used in facility security or remote monitoring, and can accept photo or video data as well as raw sensor measurements to perform additional automated analysis. This allows the system to accept more sophisticated sensor inputs and to distill from those information that an operator needs to know.

In the remote monitoring situation, it is often important to determine facility status and purpose. The method and apparatus of the present invention aids this by adding a layer of data fusion on top of the fusion from detections into events. Appropriate events are fused into objects or processes to allow longer term analysis of operations and determine trends. No reliance is placed on structure for event identification and the system can optionally use location information and can use operational time patterns for object fusion. Thus, all available information is used for fusion from events into objects and can use each type of information in an optimal manner for each situation.

Figure 1:
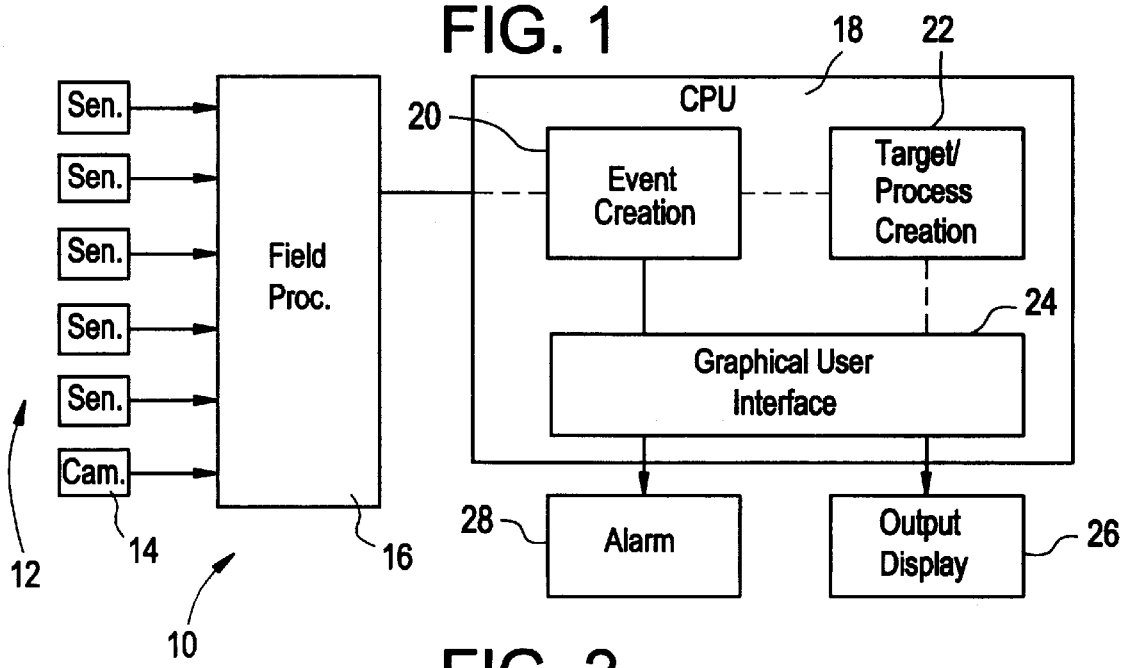
FIG. 1 is a block diagram of the device for event detection of the present invention.

The device for event detection indicated generally at 10 in FIG. 1 includes a plurality of sensors 12 of different types located to sense an event. The sensors 12 may include seismic, acoustic, magnetic and hydro-acoustic sensors for example as well as optical sensors 14 such as infrared sensors and video cameras. The outputs from the sensors are provided to a field processing unit 16 which provides the individual detections of the various types to a central processor unit 18. Since the sensors are continuously operating, the field processing unit detects a change in any sensor output and transmits it as a detection from that sensor to the central processing unit. In the central processor unit, the sensor outputs are first subjected to an event creation at 20 where detections are associated, sources are identified and located, characteristics of an event are determined and events are prioritized.

Next, at 22, a target or process creation operation (object association) may be carried out. Created events are associated to identify an object which is processed, characterized, located and tracked and an operational pattern is created.

Finally outputs are provided to a graphical user interface 24 which creates reports involving events, targets, process display and analysis and which creates map displays and tabular displays for an output display unit 26. Also, in an alarm situation, the graphical user interface will activate and alarm 28.

In accordance with the method of the present invention, certain reference data is created and stored in the central processor unit 18 to facilitate event association. The sensors 12 and 14 are deployed to cover an area of interest, and each sensor is provided with a unique sensor identification which is stored and which is provided when a detection output from that sensor is received by the central processor unit.

Next, groups of the deployed sensors are identified as expected sensor sequences of possible interest with each sensor sequence being indicative of an event. If, for example, thirty sensors are deployed over an area, a vehicle traveling on a specific path across the area from South to North may create detections by a sequence of five specific sensors while a vehicle traveling East to West may create detections by a sequence of six sensors. Thus, the different events can be identified by the sequence of sensors activated rather than by single sensor detections. Obviously, sensor sequences can be used to identify innumerable types of events, such as, for example, machine operations by sensor sequences responsive to various machine cycles.

The identification of all sensors in each sensor sequence of possible interest is stored in the central processor unit 18 as well as the expected time interval between detections from each sensor in a sequence if the expected event occurs and is sensed by the sensor sequence. An error measurement for each time interval is also stored. It should be noted that any individual sensor may be included in a plurality of different sensor sequences. An identification for each event indicated by a stored sensor sequence is also stored in the central processor unit.

Figure 2:
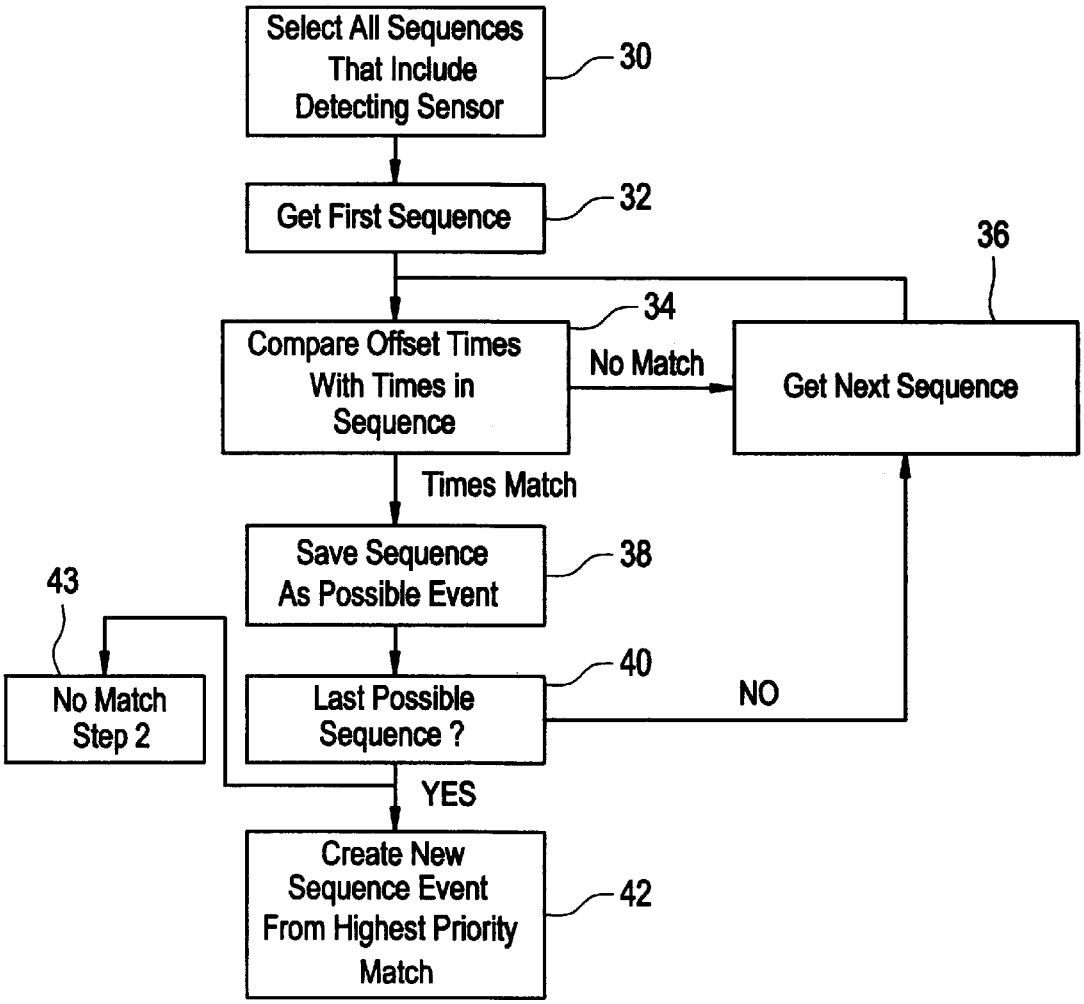
FIG. 2 is a flow diagram of the first step in event association performed by the device of FIG. 1.

The event association process is started when an identified sensor input arrives at the central processing unit 18. This event association process may occur in one or two discreet steps. First, as illustrated by FIG. 2, a check is made to determine if the newly received sensor detection is part of a defined sequence of sensor detections. This defined sequence is a previously stored list of sensor identifications with an expected time difference and error measure for detections from each sensor in the sequence. For example, if a sequence of three sensors 12/14 is identified as A0001, A0002 and A0003, the stored time difference and error measure may be as follows:

A0001

A0002 10sec+or−2sec

A0003 5sec+or−1sec

In this sequence, when we receive an output from sensor A0001, we need to receive a detection from A0002 which must be 8 seconds after the first detection, but not more than 12 seconds thereafter. Similarly, an output from A0003 must be at least 4 seconds after the detection from A0002 and not more than 6 seconds after. If the sequence matches, we create a new event from the three detections.

There are a number of different stored sequences with a unique time difference pattern for each sequence. Any sensor may be found as a component in a plurality of different sequences, and consequently at 30, all stored sequences are selected that include the identified sensor which provides the sensor input to the central processing unit. At 32 the first stored sequence including the identified sensor is selected and at 34 the times between the identified sensor input and previous and/or subsequent sensor inputs are compared with the stored times for the first selected sequence. If there is no time match, a new stored sequence containing the identified sensor is selected at 36 and the time comparison is again made at 34.

When a time match is made, the matching sequence is saved at 30 as a possible event. Then at 40 it is determined if the saved sequence is the last possible sequence involving the identified sensor. If not, at 36 the remaining sequences are selected for the time comparison at 34. When all sequences involving the identified sensor have been considered, the one with the highest priority match is used at 42 to create a new sequence event. When this occurs, the event is transmitted to the graphical user interface 24 and/or the target process creation block 22.

Figure 3:
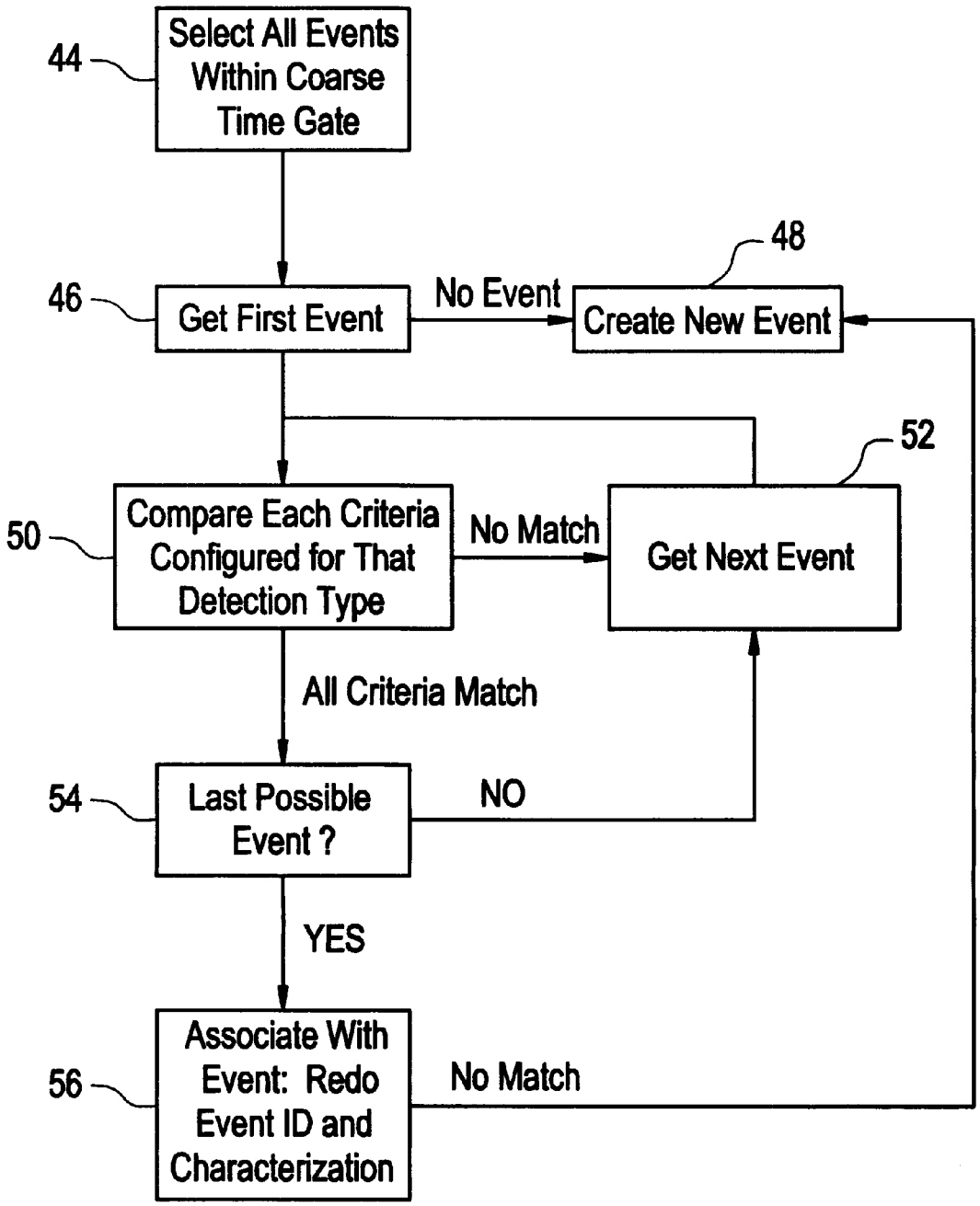
FIG. 3 is a flow diagram of the second step in event association performed by the device of FIG. 1.

The method of the present invention provides for a second step at 43 in the event association process if the initial sensor input does not prove to come in accordance with a stored sensor sequence. To accomplish this second step, a script file is stored as a reference in the central processor 18. This script file defines criteria for a number of detection classifications, and while the stored sensor sequences are site dependent, the classification criteria are not. A properly constructed classification script file acts as a classification tree with an initial stored coarse time gate providing a duration test for each event identified in the script file. Also a configurable set of parameters is stored for each detection type to determine which criteria are used in determining a match. As shown by FIG. 3, the event parameters are stored in the central processor unit, and at 44, all events occurring within a course time gate are selected. The first selected event is chosen at 46, but if no event falls within the course time gate, a new event is created at 48 indicating no stored event identification. However, if an event is present at 46, at 50 it is compared with each criteria configured for that detection type. Criteria that may be configured in addition to the course time gate are location—either distance from an event, same zone, or within a bearing cone to the event, source identification, fine time gate—used for sensors with known or expected propagation time differences, detection types: which other types of detection information may be associated with the current one, and a logical combination of any items of information contained in the sensor detection compared with any items of information about the event. In practice, the configuration is set for each sensor information type once, and used in deployment of that sensor. Thus, the intelligence behind associating sensors is moved from the analysis stage (after collection) to the pre-deployment stage. Then, during deployment, the analysis is performed automatically.

If the selected event does not match the criteria at 50, the next selected event is provided at 52 for comparison at 50. At 54, it is determined whether or not all selected events have been compared at 50, and when all selected events have been compared and a match occurs, the detection is associated with an event at 56. If no match occurs, a new event is created at 48 indicating no stored event identification.

Events are identified in step two using a hybrid of an expert system which replaces rules with tests. The tests can be literally anything, including separate user supplied programs. Thus, connectionist algorithms like neural networks are easily incorporated into what is, at a high level, an expert system. The set of tests and possible identification is configurable by site and is stored in a script file which may be constructed using a graphical script building tool. The identification mechanism is built to run specific tests against all identifications that require that test so that efficiency may be gained by eliminating most potential identifications early on. When appropriately set up, then, the identification process operates like a classification tree. Other possible organizations are possible, too, however, depending on how the script file is set up. The identifier uses all sensor evidence associated with the event so that multi-sensor tests, or individual tests on different sensors may be included. The identification mechanism works equally well with detection input, raw data, or a combination.

Figure 4:
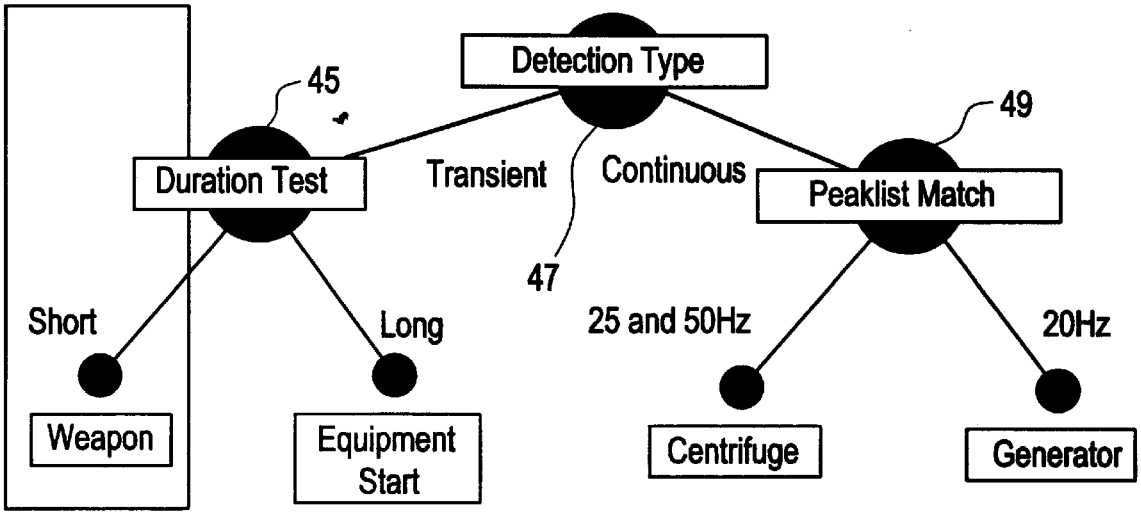
FIG. 4 is a diagram of a script file for the second step in event association.
Figure 6:
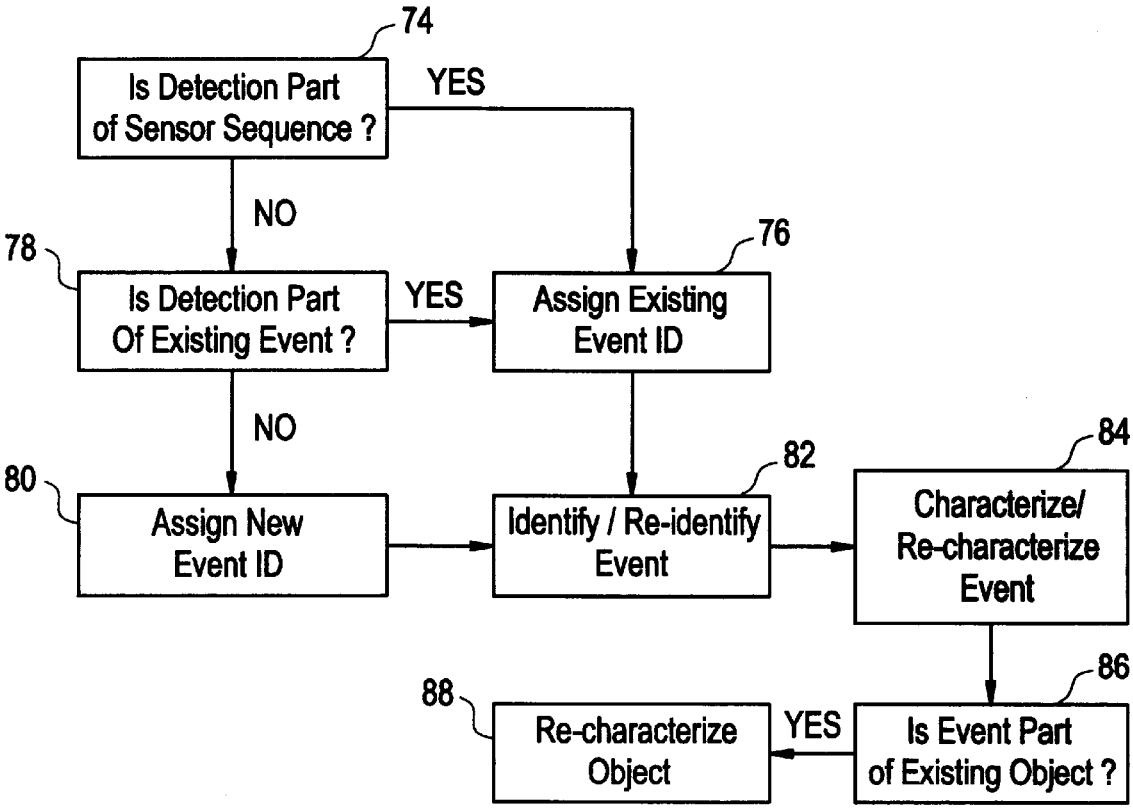
FIG. 6 is a flow diagram of the overall operation of the device of FIG. 1.

FIG. 4 is an illustration of a properly constructed classification script file which acts as a classification tree. Here the coarse time gate is incorporated in a duration test step 45. If, for example, a weapon firing is to be sensed, a short time gate would be present while an equipment start would be covered by a longer time gate.

Once a detection falls within the coarse time gate, it is compared with a stored set of parameters for each detection type at 47. Here, for example, it might be determined if the sensed detection is transient or continuous. A detection which falls within a long time gate and which is indicated to be of a continuous detection type might be programmed to be an indication of a type of running equipment. At 49 a peak list match is made based, for example, upon frequency range criteria for different types of equipment. As a result, the sensed running equipment in FIG. 4 would be identified as either a centrifuge or a generator, and this would be the event identification provided.

In addition to performing identification of the event source, often there are characteristics of the event that may be determined to provide more information. In the case of a vehicle, we may calculate speed and direction or provide more information such as number of cylinders or manual vs. automatic transmission. In the case of a fixed piece of equipment such as a generator, it may be possible to determine whether it is operating under load or not. Usually, these additional calculations only make sense for certain event types (calculating speed and direction for a fixed generator is not appropriate, for example). What additional characterization is to be performed is configured under the annunciation configuration. Users can determine what type of location calculations to perform, what additional algorithms to run, and how the user is to be notified of the event (from among: display on a map, flashing display on a map, audible alarm, dialog box, automatic email, fax, or page, or automatic export of the event information to another station). This flexible annunciation and characterization allows the system to provide additional useful information about an event and provides the operator a mechanism for focusing on the events of most interest (since in virtually every scenario, the normal, everyday activities form the overwhelming majority and do not require operator intervention). This structure also allows for configurable, automated response to an event. For example, in an attack by a chemical agent, it may be desirable to change the HVAC configuration to limit what area is affected.

The system and method of the present invention is capable of associating events together into objects or processes for longer term trend or traffic analysis on a timeline. The process is configured by defining an object type which includes criteria for determining event 'evidence' for the object. The criteria are taken from source identification, location information, and/or time pattern information. Once events are associated with an object, the object may be characterized as to current state, operations patterns, location (multiple event locations may be convolved to obtain a more accurate, fused location), or function.

For object association, objects defined by a plurality of identified events are stored as a reference in the central processor unit 18. Once events are identified by the event association process, all stored objects that include one of the identified event source identifications are selected at 58 and the first selected object is chosen for comparison at 60. If no object includes the event source identification, an indication is provided at 62 that the event is not part of the object.

If an object is provided at 60, at 64 the object is compared for each criteria configured for that object type. If no match is forthcoming, the next object is selected for comparison at 66. However, when all criteria match the selected object at 68, action is taken at 70 to assure that all objects selected at 58 are compared with the criteria at 64, and the object association for the specific event identified is terminated at 72.

Figure 5:
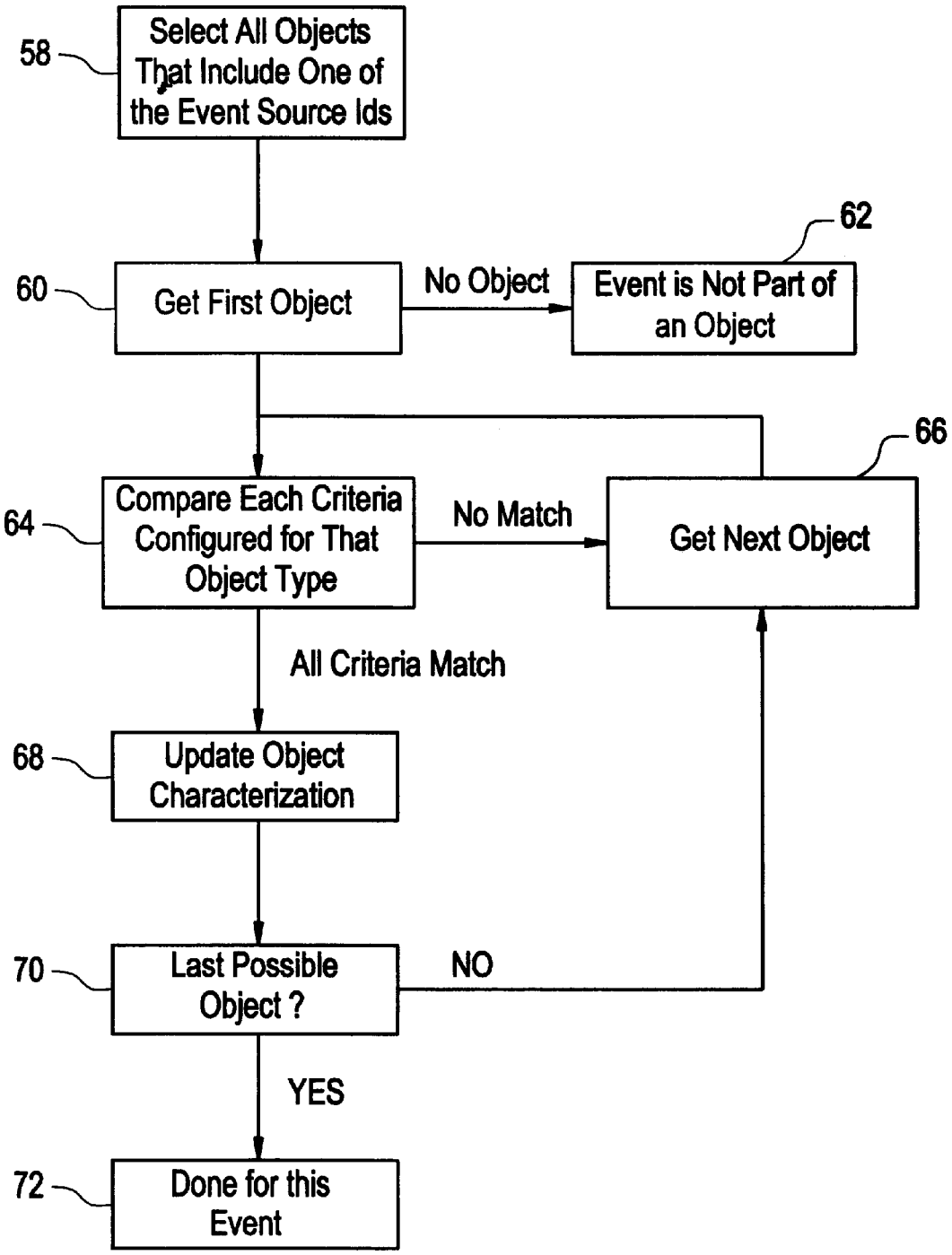
FIG. 5 is a flow diagram of the object association steps performed by the device of FIG. 1.

The overall operation of the device for event detection 10 is illustrated by FIG. 5. At 74 it is determined if a detection by a sensor is part of a sensor sequence, and if a sequence is identified, an existing event identification is assigned at 76. If the detection is not identified as part of a sensor sequence, a check is made at 78 to determine if the detection is part of an existing event. If an existing event is identified, an existing event identification is assigned at 76, but if no existing event is identified, a new event identification is assigned at 80. At 82, the new event is identified or the existing event is re-identified, and the event is characterized or re-characterized at 84. At 86 it is determined whether or not the event is part of an existing object, and if it is, the object is re-characterized at 88.

We claim:

1. A method utilizing data from a multiplicity of sensor sources for detecting the occurrence of one of a plurality of different possible events which may occur within an area of interest which includes:

deploying a plurality of sensor sources to provide sensor detections for an area of interest;

choosing from said plurality of deployed sensor sources a unique group of sensor sources for each of said plurality of events to provide a specific sensor detection sequence associated with each event;

identifying allowable time intervals between each sensor detection from sensor sources in each sensor detection sequence which will occur for said sensor detection sequence to indicate the occurrence of the event associated therewith;

operating upon the receipt of a sensor detection from a first sensor source to identify all sensor detection sequences which include said first sensor source;

operating upon receipt of one or more subsequent sensor detections from one or more additional sensor sources to compare the actual time interval between a sensor detections with the allowable time intervals between sensor detections in each identified sensor sequence containing said first sensor source; and when all of said actual time intervals fall within said allowable time intervals for one of said identified sensor sequences, identifying the event indicated by said one identified sensor sequence.

2. The method of claim 1 wherein the identified allowable time intervals between sensor detections from sensor sources in each identified sensor detection sequence each include a primary time difference combined with an error time.

3. The method of claim 1 which includes deploying a plurality of sensor sources of different types to provide different types of sensor detections.

4. The method of claim 1 which includes identifying one or more objects defined by a plurality of identified events;

identifying criteria for each identified object, determining whether an event indicated by an identified sensor detection sequence is included in an identified object, comparing all identified objects containing the event to the identifying criteria, and providing an object identification when an identified object containing the event matches the identifying criteria.

5. The method of claim 4 wherein the identified allowable time intervals between sensor detections from sensor sources in each identified sensor detection sequence each include a primary time difference combined with an error time.

6. The method of claim 5 which includes deploying a plurality of sensor sources of different types to provide different types of sensor detections.

7. The method of claim 1 which includes providing a script file including a plurality of events which defines criteria for a number of different detection classifications for event identification, said criteria including a coarse time gate for each event identified in the script file and a configurable set of event parameters for each detection classification, operating when the receipt times of the sensor detections from said first and additional sensor sources do not match the allowable time intervals for an identified sensor detection sequence to compare said first and additional sensor source detections with said script file, and identifying an event from said script file when the sensor source detections match the criteria for a detection classification.

8. The method of claim 7 which includes identifying one or more objects defined by a plurality of identified events, identifying criteria for each identified object, determining whether an identified event is included in an identified object, comparing all identified objects containing the identified event to the identifying criteria, and providing an object identification when an identified object containing the event matches the identifying criteria.

9. The method of claim 8 wherein the identified allowable time intervals between sensor detections from sensor sources in each identified sensor detection sequence each include a primary time difference combined with an error time.

10. The method of claim 9 which includes deploying a plurality of sensor sources of different types to provide different types of sensor detections.

11. A device for detecting the occurrence of one of a plurality of different possible events which may occur within an area of interest comprising:

a plurality of sensors each operative when activated to provide a sensor detection signal; and a processor unit connected to receive said sensor detection signals and operating to store data relating to a plurality of different detection sequences, each of which is associated with one of said plurality of different possible events, data for each detection sequence including the identity of each sensor included in a detection sequence and allowable time intervals between successive sensor detection signals from sensors in each detection sequence;

said processor unit operating in response to a first received sensor detection signal from a sensor to identify all detection sequences which include said sensor and to subsequent received detection signals to determine whether actual time intervals occurring between detection signals fall within the allowable time intervals stored for one of said identified detection sequences.

12. The device of claim 11 wherein said sensors include sensors of different types which provide sensor signals in response to different types of sensor detections.

13. The device of claim 12 wherein said processor unit provides an identification of the occurrence of an event when the actual time intervals occurring between detection signals fall within the allowable time intervals stored for an identified detection sequence associated with the event identified.

* * * * *